US010018431B2

(12) United States Patent
Harkleroad et al.

(10) Patent No.: US 10,018,431 B2
(45) Date of Patent: Jul. 10, 2018

(54) CONDENSATE REMOVAL SOOTBLOWER NOZZLE

(71) Applicant: Diamond Power International, Inc., Lancaster, OH (US)

(72) Inventors: Matthew R. Harkleroad, Pinkerington, OH (US); Steven R. Fortner, Rockbridge, OH (US); Tony F. Habib, Lancaster, OH (US); Clinton A. Brown, Baltimore, OH (US)

(73) Assignee: DIAMOND POWER INTERNATIONAL, LLC, Lancaster, OH (US)

( * ) Notice: Subject to any disclaimer, the term of this patent is extended or adjusted under 35 U.S.C. 154(b) by 362 days.

(21) Appl. No.: 14/820,150

(22) Filed: Aug. 6, 2015

(65) Prior Publication Data

US 2015/0345878 A1 Dec. 3, 2015

Related U.S. Application Data

(63) Continuation of application No. PCT/US2014/015209, filed on Feb. 7, 2014.
(Continued)

(51) Int. Cl.
*B05B 1/14* (2006.01)
*F28G 9/00* (2006.01)
(Continued)

(52) U.S. Cl.
CPC ..... *F28G 9/00* (2013.01); *B05B 1/044* (2013.01); *B05B 1/14* (2013.01); *B05B 1/34* (2013.01); *B05B 15/064* (2013.01); *B05B 15/628* (2018.02); *B08B 1/005* (2013.01); *B08B 3/024* (2013.01); *F22B 37/54* (2013.01);
(Continued)

(58) Field of Classification Search
CPC . F28G 9/00; F28G 1/166; F28G 15/00; F28G 15/04; B05B 1/044; B05B 1/14; B05B 1/34; B05B 15/064; B05B 13/0468; B05B 1/20; B05B 1/046; B05B 15/02;
(Continued)

(56) References Cited

U.S. PATENT DOCUMENTS 3,269,365 A 8/1966 Kochey, Jr.
3,593,691 A 7/1971 Wirths et al.
(Continued)

OTHER PUBLICATIONS

International Search Report for PCT/US2014/015209.

*Primary Examiner* — Steven J Ganey
(74) *Attorney, Agent, or Firm* — Brinks Gilson & Lione

(57) ABSTRACT

A nozzle block for a sootblower of the type for cleaning internal heat transfer surfaces of large scale coal fired combustion systems. For cleaning the internal surfaces, a cleaning medium is often used in the form of steam. Due to the cyclical operations and the process of condensation, condensate slugs of water can form in the sootblower fluid flow components. If these slugs are ejected against clean surfaces, undesirable erosion can occur. Several embodiments of nozzle blocks are described each having one or more ejection ports at their distal ends configured to maximize the ejection of condensates while minimizing their cross-sectional area which would diminish nozzle fluidic efficiency. Additional features enhance the ability of the nozzle block to separate and disperse condensate from the slots.

34 Claims, 8 Drawing Sheets

Related U.S. Application Data

(60) Provisional application No. 61/762,613, filed on Feb. 8, 2013.

(51) Int. Cl.

| | |
|---|---|
| ***B05B 1/34*** | (2006.01) |
| ***F22B 37/54*** | (2006.01) |
| ***B05B 15/628*** | (2018.01) |
| ***F28G 15/00*** | (2006.01) |
| ***F28G 1/16*** | (2006.01) |
| ***F28G 15/04*** | (2006.01) |
| ***B05B 1/04*** | (2006.01) |
| ***B05B 15/06*** | (2006.01) |
| ***B08B 1/00*** | (2006.01) |
| ***B08B 3/02*** | (2006.01) |
| ***F23J 3/02*** | (2006.01) |

(52) U.S. Cl.
CPC ..... *F23J 3/023* (2013.01); *F28G 1/166* (2013.01); *F28G 15/00* (2013.01); *F28G 15/04* (2013.01)

(58) Field of Classification Search
CPC B08B 1/005; B08B 3/024; F22B 37/54; F23J 3/023; Y10S 239/13
USPC ..... 239/110, 461, 548, 566, 567, 589, 750, 239/752, 753, DIG. 13; 15/316.7, 317; 122/390, 392, 379
See application file for complete search history.

(56) References Cited

U.S. PATENT DOCUMENTS

| | | | | |
|---|---|---|---|---|
| 4,422,882 | A | 12/1983 | Nelson et al. | |
| 5,063,632 | A | 11/1991 | Clark et al. | |
| 5,241,723 | A | 9/1993 | Garrabrant | |
| 5,320,073 | A | 6/1994 | Silcott et al. | |
| 5,416,946 | A | 5/1995 | Brown et al. | |
| 5,423,483 | A * | 6/1995 | Schwade | B08B 3/02 239/589 |
| 5,509,607 | A * | 4/1996 | Booher | B08B 9/093 122/390 |
| 5,687,449 | A | 11/1997 | Zachay et al. | |
| 5,778,831 | A * | 7/1998 | Jameel | B05B 1/34 122/392 |
| 5,873,142 | A | 2/1999 | Theiss | |
| 6,764,030 | B2 | 7/2004 | Habib et al. | |
| 8,770,155 | B2 * | 7/2014 | Tandra | F23J 3/023 15/318 |
| 2004/0222324 | A1 | 11/2004 | Habib et al. | |
| 2005/0125932 | A1 | 6/2005 | Kendrick | |
| 2013/0019897 | A1 | 1/2013 | Zachay | |

* cited by examiner

CONDENSATE REMOVAL SOOTBLOWER NOZZLE

CROSS REFERENCE TO RELATED APPLICATION

The present patent application claims the benefit of priority to the following applications, and is a continuation of PCT Application No. PCT/US2014/015209 filed Feb. 7, 2014, which claims priority to U.S. Provisional Patent Application No. 61/762,613, filed Feb. 8, 2013.

BACKGROUND AND SUMMARY OF THE INVENTION

This invention is related to a cleaning device for combustion devices and particularly to one for large scale combustion devices for the reduction of soot and/or slag encrustations forming on internal heat exchange surfaces.

During the combustion process of fossil fuels such as coal, the internal heat exchange surfaces of boilers and other combustion devices become encrusted with slag and soot. In order to enhance the thermal and combustion efficiency of such devices, it is necessary to reduce the amount of encrustations on the heat exchanger surfaces. Numerous techniques for boiler cleaning are in use today. One approach is the use of so-called sootblowers which project a stream of cleaning medium such as air, steam, or water, or mixtures of these materials against the internal heat exchange surfaces which cause the accumulated encrustations to be removed through mechanical and thermal shock.

Various types of sootblower systems are used today. One type of sootblower is positioned permanently inside a boiler and is actuated periodically to eject a sootblowing medium. Other types are retractable and include the so-called long retracting sootblowers having a long lance tube which is periodically advanced into and retracted from the heat exchanger. The lance tube features one or more nozzles at its distal end from which the cleaning medium is ejected. The retraction feature of these sootblowers enables the lance tube to be removed from the intense heat within the combustion device between the cleaning cycles which would otherwise damage the lance tube. In most applications of long retracting sootblowers the lance tube is simultaneously rotated as it is axially extended into and out of the boiler so that the stream of sootblowing medium traces a helical or oscillating path during the cleaning cycle. Sootblowers are normally operated intermittently in accordance with a schedule which considers cleaning requirements, sootblower medium consumption, boiler thermal efficiency, and various other factors.

In cases where steam or a mixture which includes steam is used as the cleaning medium and the sootblower is actuated intermittently, there is a tendency for liquid condensate to collect in the cleaning medium supply circuit and lance tube between actuation cycles. At the beginning of the next actuation cycle when the cleaning medium supply valve is opened, the collected condensate is ejected from the cleaning nozzles in the form of liquid slugs. In some conditions, when such slugs of condensate strike the boiler wall surfaces and heat transfer tubes, erosion occurs due to an excessive level of thermal and mechanical shock. Such degradation of the heat exchange components of a boiler can cause failures and limit the operating life of the boiler which is a significant financial cost for the boiler operator. In view of the foregoing, a need exists for a sootblower system which accommodates condensate slugs without causing boiler component damage.

In addition to concerns regarding condensed steam forming between actuation cycles, or at the beginning of a cleaning cycle, there are applications in which it is desirable to use saturated or low quality steam as the cleaning medium. In such applications, the presence of condensate is expected as part of the cleaning medium flow supplied to the sootblower lance tube during a cleaning cycle. It is accordingly desirable to provide a sootblower lance assembly which permits the use of such cleaning medium while separating and safely ejecting entrained condensate.

Various sootblower configurations are known which seek to avoid the disadvantages associated with ejection of condensate when using steam as the cleaning medium. An example of such designs is provided with reference to applicant's previously issued U.S. Pat. No. 5,063,632. Although such devices generally operate satisfactorily, they have a number of significant disadvantages. For example, in some instances, such devices choke the flow of cleaning medium due to interference between the opposed cleaning medium nozzles. Sootblower nozzles are designed to provide efficient conversion of the static and dynamic pressure of the supplied sootblowing medium into a stream ejected from the cleaning nozzle(s) which has a high cleaning effect or peak impact pressure. Fluid flow interference caused by a disrupted cleaning medium flow at the nozzle entrance may lead to performance degradation. Further disadvantages of known sootblower nozzle blocks for condensate ejection include the requirement of complex internal welded components which can become dislodged or deteriorate during use.

One known technique for reducing condensate ejected from the cleaning nozzles is to use a port at the distal end of the lance tube provided to allow the ejection of condensate at the terminal end along the longitudinal axis of the sootblower nozzle block. This approach, described in the previously referenced US patent, creates a continuously open flow path initially for condensate ejection but thereafter permits cleaning medium to escape. Since cleaning medium ejected along the lance tube longitudinal axis is, in most applications, not useful for providing a cleaning effect, this discharge flow constitutes an efficiency degradation of the sootblower's operating performance. An ejection port at the nozzle block distal end produces a spray of condensate into the boiler internal volume. Although, as mentioned previously, ejection of condensate in this direction typically does not lead to undesirable consequences, it is preferable that a port for condensate ejection acts as an "inefficient" nozzle, in terms of generating a coherent high velocity stream of condensate at a given supply pressure. Ideally the condensate spray pattern ejected from a condensate port would be highly dispersed with low impact pressure characteristics.

In sootblowing applications, it is desirable to preserve the supplied sootblowing medium's dynamic and static pressure as it is converted to a stream of cleaning medium emitted from the lance tube nozzles which provides a high dynamic cleaning effect. Accordingly, it is desirable to provide a nozzle block which provides the previously noted desirable features while maintaining excellent performance in terms of cleaning effect.

This invention is related to a sootblower system incorporating a novel lance tube nozzle block having features for reducing the quantity of condensate ejected from cleaning nozzles forming on the inside of the nozzle block, lance tube, poppet valve, and related plumbing passageways or entrained in the cleaning medium supply in a manner which does not lead to boiler tube erosion. The sootblower cleaning nozzles which are aimed at the heat transfer surfaces to be cleaned, spray a steam or a steam/air mixture relatively free of condensate. Accordingly, this invention is capable of substantially minimizing the erosive effect caused by an initial output of a slug of condensate, or condensate present in a steady-state condition against heat transfer surfaces in a boiler. The nozzle block in accordance with this invention provides a condensate separation feature and further a means for ejecting the condensate from the nozzle block in a manner which, for intended applications, does not cause boiler tube erosion. Furthermore, the condensate separating effect provided by the nozzle block in accordance with this invention allows the use of saturated steam or a steam/water mixture for the purposes of cooling the lance tube, while avoiding the degree of heat exchanger erosion which would occur if all the condensed or entrained liquid water were sprayed against the heat exchanger surfaces from cleaning nozzles.

The nozzle block in accordance with an embodiment of this invention is preferably formed as an integral casting and forms two separated flow paths for the cleaning medium. The flow is separated at about the diametric mid-plane of the lance tube inside diameter by a divider wall to define two separated flow paths dedicated to separate nozzles. Each of the flow paths travels to the terminal end of a nozzle block where it undergoes a sharp "U-turn" bend (i.e. about 180°) and then extends rearward and terminates at a sootblower nozzle for spraying the cleaning medium radially from the nozzle block. The two separated flow paths are intertwined within the nozzle block interior. In one embodiment, the terminal end of the nozzle block features a pair of elongated slot passageways which serve to provide an ejection port for condensate. A slot is provided for each of the flow paths and has a particular orientation with respect to the cleaning medium flow to enhance the condensate separation effect. While the slot provides an effective condensate separation effect, it's cross-sectional flow area remains small, resulting in a low percentage of cleaning medium passing through the slots not available for cleaning purposes.

Various embodiments of this invention are described. In one embodiment, the previously mentioned flow path orientations are provided with the condensate ejection slots. In a further embodiment, the interior nozzle flow paths have the features for guiding condensate adhering to the internal surfaces of the nozzle block passageways toward and out of the condensate ejection slots. A still further embodiment provides condensate ejection for a single distal end nozzle for a nozzle block which does not divide the flow paths between a pair of nozzles, or with features only a single distal end nozzle.

Additional benefits and advantages of the present invention will become apparent to those skilled in the art to which the present invention relates from the subsequent description of the preferred embodiment and the appended claims, taken in conjunction with the accompanying drawings.

DETAILED DESCRIPTION OF THE PREFERRED EMBODIMENTS

Figure 1:
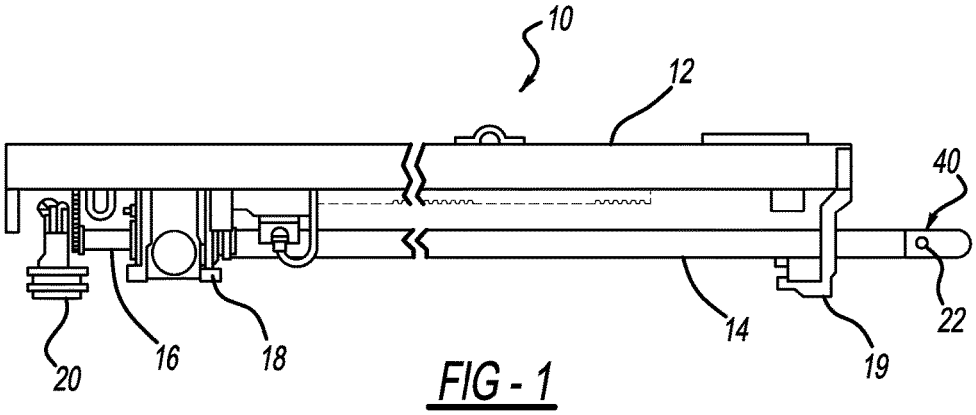
FIG. 1 is pictorial view of a long retracting sootblower which is an example of one type of sootblower with which the present invention may be employed.

FIG. 1 illustrates a long retracting type sootblower which is an example of one type which can be employed with the nozzle block in accordance with present invention. The sootblower as shown in FIG. 1 is generally designated by reference number 10 and has a construction as disclosed by U.S. Pat. No. 3,439,376 granted to J. E. Nelson et al on Apr. 22, 1969, which is hereby incorporated by reference. Sootblower 10 principally comprises frame assembly 12, lance tube 14, feed tube 16, and carriage 18. Sootblower 10 is attached to an associated boiler by mounting front bracket 19 to boiler side wall 28 (shown in FIG. 2). FIG. 1 shows sootblower 10 in its normal resting position. Upon actuation, lance tube 14 is extended into and retracted from the boiler interior and is typically simultaneously rotated (either through full rotations as in a helix or in an oscillating motion). A sootblowing cleaning medium such as air, steam, or water, or a mixture of these fluids (or some other material) is supplied to poppet valve 20 and fed through feed tube 16 which is held stationary. As lance tube 14 is extended into the boiler, it telescopes over feed tube 16. A fluid seal (not shown) is provided between tubes 14 and 16 to enable the sootblowing medium to be ejected from one or more cleaning nozzles 22. This invention is associated with the use of steam or a steam/air mixture as the cleaning medium, or another cleaning medium in which condensate or entrained liquids may be present.

Figure 2:
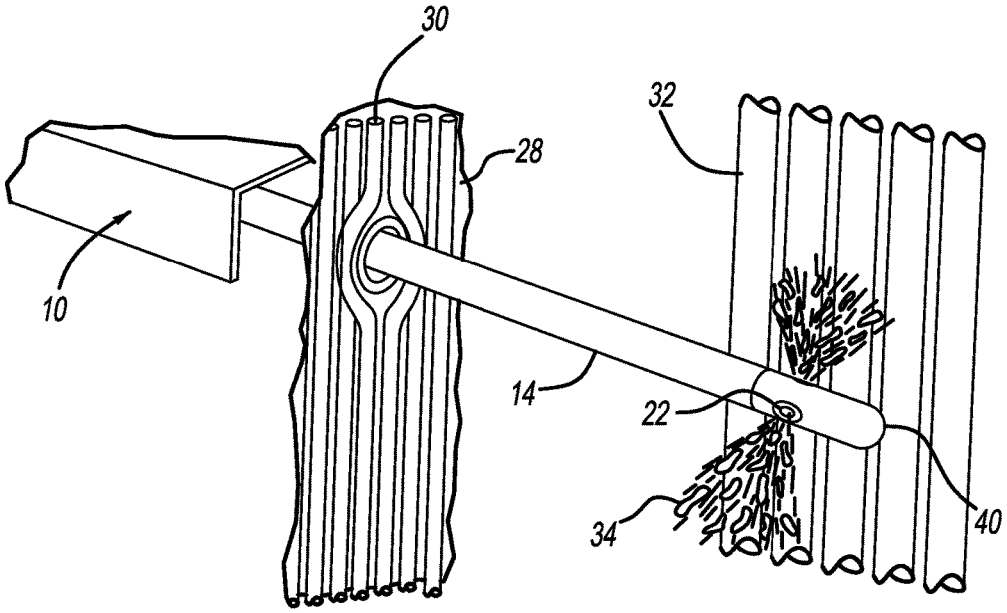
FIG. 2 is a pictorial view of a conventional long retracting sootblower showing condensate being ejected against a pendant section of boiler tubes in a boiler.
Figure 3:
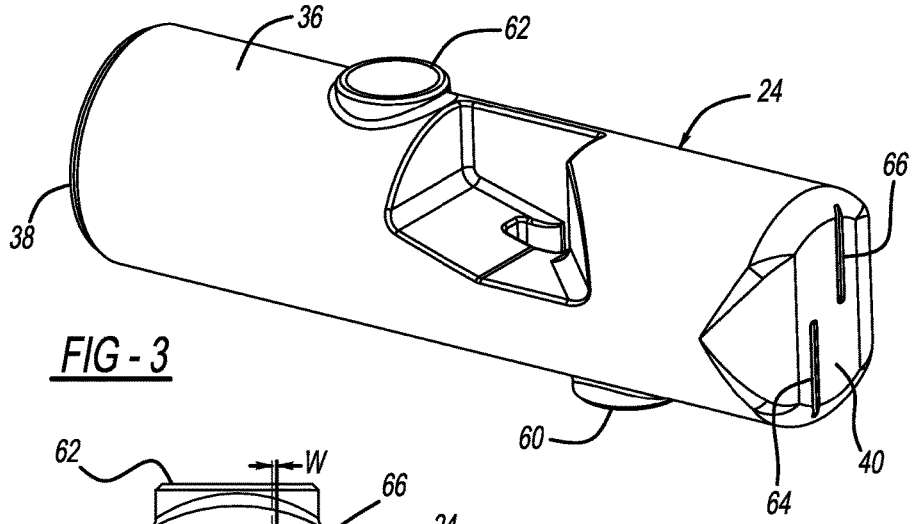
FIG. 3 is a pictorial view of a nozzle block in accordance with the present invention.
Figure 4:
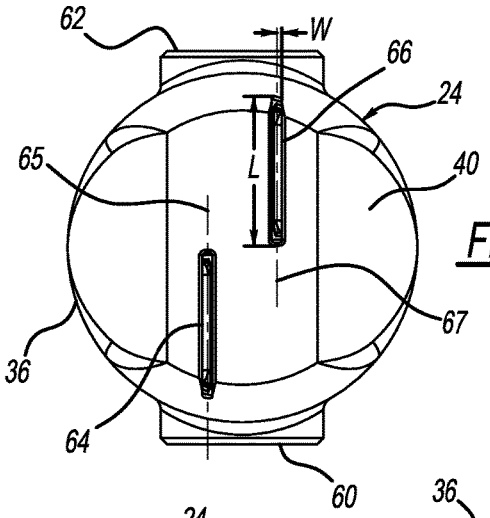
FIG. 4 is an end view of the nozzle block shown in FIG. 3.

Now with reference to FIG. 2, a sootblowing system of a conventional configuration is shown as background for presenting the advantages provided by the present invention. As shown in FIG. 2, lance tube 14 is shown protruding through the side wall 28 of the heat exchanger which is covered by an array of heat transfer wall tubes 30. In this application, sootblower 10 is provided for cleaning a pendant (i.e. hanging) section of boiler tubes 32. Another row of pendant tubes 32 would typically be provided laterally opposite the section shown but is not shown for the sake of clear illustration. Depending on the application, sootblower nozzle 22 may also be oriented to clean other surfaces within a heat exchanger, such as back against wall tubes 30. As discussed previously, in applications where steam or a steam/air mixture is used as a cleaning medium, between actuation cycles, steam which remains within lance tube 14, feed tube 16, and/or the associated fluid supply circuit will condense. In such instances, at the starting point of a cleaning cycle, the condensed liquid may be ejected forcibly from sootblower cleaning nozzles 22. Also, when using saturated or low quality steam as the cleaning medium, condensate may be present which is entrained in the supplied medium during steady-state operation. As illustrated in FIG. 2, such unpurged condensate formed in the cleaning medium feed system or within the sootblower itself or entrained in the supplied cleaning medium is ejected at high velocity through the nozzle 22 onto pendant section boiler tubes 32 and is shown in the form of droplets or slugs 34. As mentioned previously, this can cause significant deterioration of the heat transfer surfaces within the boiler and this invention seeks to avoid such negative consequences.

A nozzle block 24 in accordance with a first embodiment of the present invention is illustrated in FIGS. 3 through 6 and is formed from a body or housing 36. Preferably, body 36 is formed by a casting process as will be described in further detail in the following description. Nozzle block 24 forms proximal end 38 which is affixed to a hollow lance tube 14 such as by welding. Distal end 40 is the terminal end of the lance tube assembly. Body 36 forms two internal cleaning medium passageways formed by internal wall surfaces referred to as first nozzle passageway 42 and second nozzle passageway 44. These passageways are separated by divider wall 46 extending along a diametric center plane 68 of nozzle block body 36. After cleaning medium flows into lance tube 14 and reaches divider wall 46, two separated flow streams of cleaning medium are created. For both passageways 42 and 44, the cross-sectional flow area of the flow passageway decreases from the entrance at divider wall 46 and becomes necked down to form axial flow passageways 48 and 50, respectively, extending on opposite sides of the diametric center plane 68. These passageways 42 and 44 are generally semi-circular (in cross section) cavities which extend from divider wall 46 toward distal end 40. Both nozzle passageway 42 and 44 undertake a U-shaped turns (about 180°) 49 and 51 at distal end 40 crossing midplane 68 and transition to retrograde sections 52 and 54, respectively. These sections 52 and 54 then transition to 90° (approximate) elbow sections 56 and 58 and finally terminate at respective nozzle outlets 60 and 62, which are centered on midplane 68.

Figure 7A:
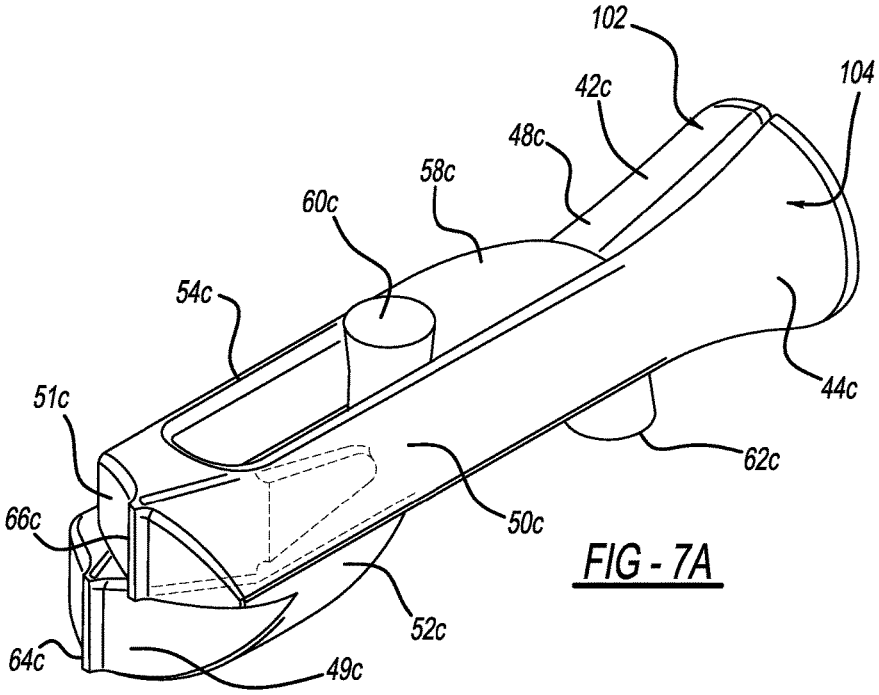
FIGS. 7A, 7B, and 7C are alternate pictorial views of the nozzle block inside cavities forming the nozzle passageways shown as cores used to form the inside cavities.
Figures 7B, 7C:
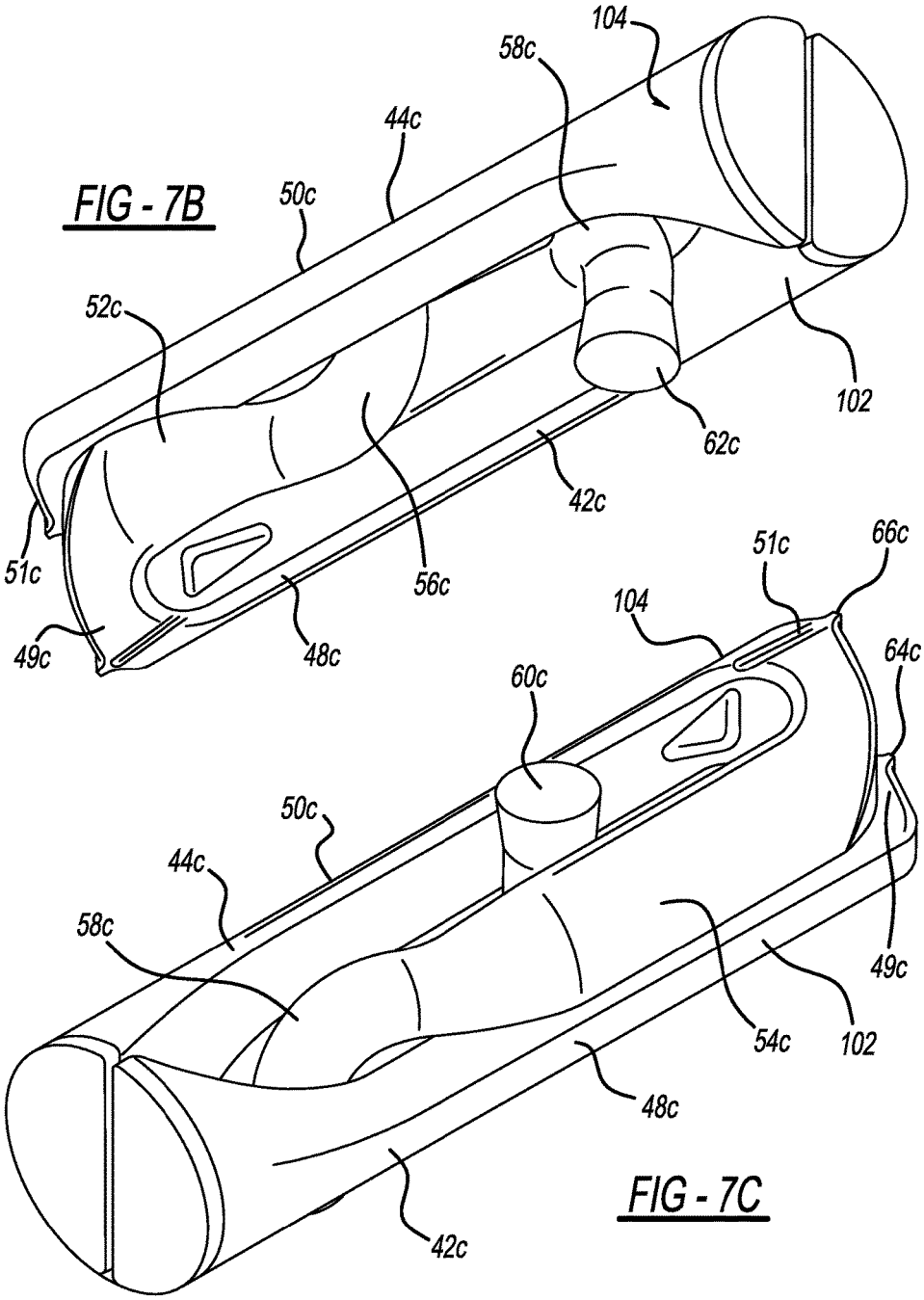
Figure 8:
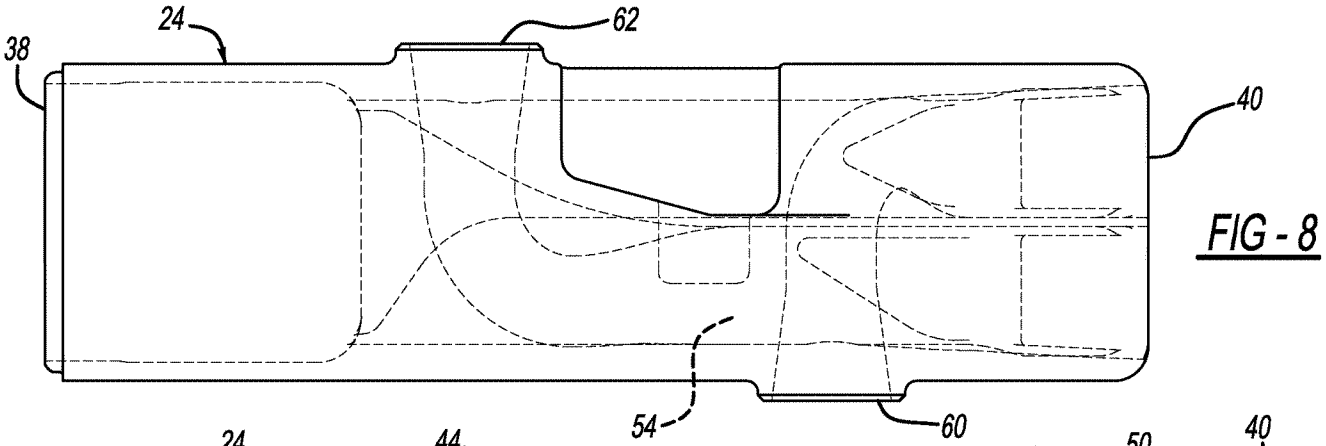
FIG. 8 is a side view of a nozzle block showing additional features of the invention.

FIGS. 7A through 7C show the configuration of nozzle passageway 42 and 44 by illustrating three-dimensional molding cores 102 and 104 which could be used for casting nozzle block body 36 and forming the internal wall surfaces of the nozzle block. Portions of the cores which form particular features are identified by the reference numbers used for those features with a "c" (for core) suffix (for example, core section 48*c* forms axial flow passageway 48, etc.). As shown in FIG. 7A, passageway core sections 42*c* and 44*c* become intertwined with one another and second nozzle passageway core section 44*c* terminates at nozzle outlet core section 62*c*, which is farther from distal end 40 than is nozzle outlet core section 60*c*. The cross-sectional configuration of the passageway at nozzle outlets 60 and 62 can feature various configurations well known in compressible flow nozzle theory, such as the Laval-type nozzle featuring a converging/diverging wall having a restricted throat cross-sectional area and an enlarging cross-sectional area going from the throat to the discharge nozzle outlet core sections 60*c* and 62*c*.

Figure 6:
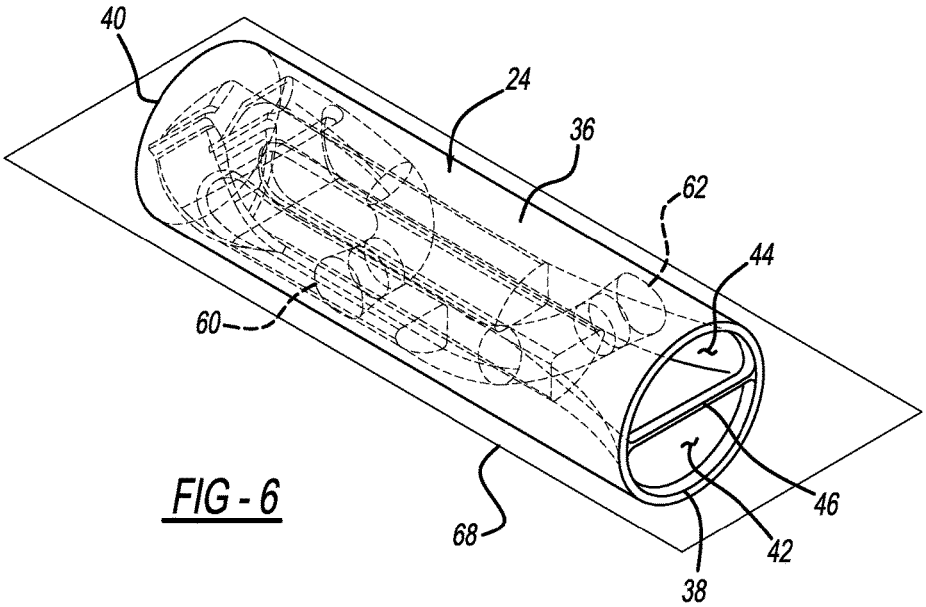
FIG. 6 is a pictorial view of the nozzle block in accordance with this invention showing internal surfaces in phantom lines.

The configuration of the internal flow passageway within nozzle block 24 are further described in relation to diametric midplane 68 which passes through the nozzle block (see FIG. 6). Divider wall 46 lies on midplane 68. The first and second axial flow passageway 48 and 50 lie on opposite sides of midplane 68, and retrograde sections 52 and 54 lie on opposite sides of the midplane from their respective connected nozzle passageway 48 and 50. Thus, first axial passageway 48 extends along one side of midplane 68, then U-turn 49 crosses the midplane, and thereafter retrograde section 52 extends on the opposite side of the midplane. Elbow section 56 forms nozzle outlet 60 which lies on midplane 68. Axial flow passageway 50 has a similar relation to midplane 68, with nozzle outlet 62 also centered on midplane 68.

A significant features of nozzle block 24 is the provision of a pair of condensate ejection slots 64 and 66 extending along mid-lines 65 and 67 respectively, which open at nozzle block body distal end 40. As shown best by FIG. 4, slots 64 and 66 are significantly narrower than their length ("L") and are oriented such that their narrow (width "W") dimension is parallel to the flow of cleaning medium as it undergoes U-turns 49 and 51 (the length L dimension is perpendicular to the flow at the slots). The advantages and features of slots 64 and 66 will be described in greater detail. Slots 64 and 66 form extending midlines 65 and 67, extending in their length ("L") direction. As mentioned previously, slots 64 and 66 have a constant width (W) along midlines 65 and 67. The embodiments shown feature slots 64 and 66 formed by midlines 65 and 67 which are straight lines. However, midlines 65 and 67 could be curved, for example in a letter "C" shape, or partially arcuate. Importantly, slot 64 and 66 are oriented such that mid-lines 65 and 67 are at or nearly perpendicular to the flow of fluid passing through nozzle passageway 42 and 44 at U-turns 49 and 51. Other possible shapes such as slots having a constant width formed along curved paths or other shapes could be provided. In any event, it is a principal feature of the invention that the ejection slots 64 and 66 are not round and have a greater length (L) than width (W) and are oriented such that the width (W) dimension is aligned with the flow path of a cleaning medium as it flows through elbow sections 56 and 58.

The configurations of nozzle internal flow passageways 42 and 46 provide a number of significant features from a fluid flow perspective. By separating the flow into two paths and isolating them, the effects of interference and turbulence caused by their interaction is eliminated. The retrograde folded-back configuration of the passageways provides a long flow path for the fluid flow to become more laminar, thus reducing high degrees of turbulence which degrades nozzle efficiency. By forming nozzle block body 36 as a one-piece casting, problems associated with loose internal components are avoided entirely. The flow of the cleaning medium close to the entire outside surface of nozzle block body 36 from proximal end 38 to distal end 40 ensures that the nozzle block body is cooled by the flow cleaning medium. This avoids formation of highly heated areas of nozzle block 24 which can lead to deterioration.

The shape and orientation of slots 64 and 66 is important for their operation. Slots 64 and 66 provide an ejection pathway for condensate which is entrained in the cleaning medium flow or forms on internal wall surfaces of the nozzle block body 36. Slots 64 and 66 are positioned at the outer portion of the internal wall surface of U-turns 49 and 51 (i.e. the outside part of the turns) where inertia of the more dense entrained particulates tend to cause them to flow toward the outer section of the passageway at the U-turns (or the action of the apparent centrifugal force) where it can be intercepted by the presence of slots 64 and 66. Thus entrained liquid in the cleaning medium flow becomes directed against the outer surface forming U-turns 49 and 51 where the condensate encounters slots 64 and 66. The internal pressure of the cleaning medium within nozzle block body 36 causes the condensate flowing to slots 64 and 66 to be ejected from the slots. The leakage of cleaning medium through slots 64 and 66 represents an incremental decrease in the efficiency of the cleaning effect provided by the nozzle block 24. This is the case since cleaning medium escaping slots 64 and 66 is not directed in a manner to provide desired cleaning of heat transfer surfaces. In order to reduce this loss, the cross-sectional flow areas of slots 64 and 66 are intentionally minimized. In one embodiment of the present invention the cross-sectional flow area provided by slots 64 and 66 are about 15% of the cross-sectional area of the throats of their respective nozzle outlets 60 and 62.

Slots 64 and 66 can be made very thin in width (W) such that they produce a relatively small flow area. For the embodiments shown, slots 64 and 66 have a length dimension L and a width dimension W, wherein the length (L) is more than five times the width (W) providing a generally rectangular shape. The length (L) of slots 64 and 66 however is selected to ensure that they extend across the majority of the cross-sectional width of the flow passageway at U-turns 49 and 51, increasing the condensate that is intercepted by the presence of the slots. Prior art systems utilizing round holes at the distal end of the sootblower, while permitting condensate ejection, have an inherent low efficiency caused by the large flow area of the condensate ejection port. Other possible shapes such as slots 64 and 66 having a constant width formed along curved paths or other shapes could be provided. In any event, it is a principal feature of the invention that the ejection slots 64 and 66 are not round and have a greater length (L) than width (W) and are oriented such that the width dimension is aligned with the flow path of a cleaning medium as it flows through U-turn sections 49 and 51.

Figure 5:
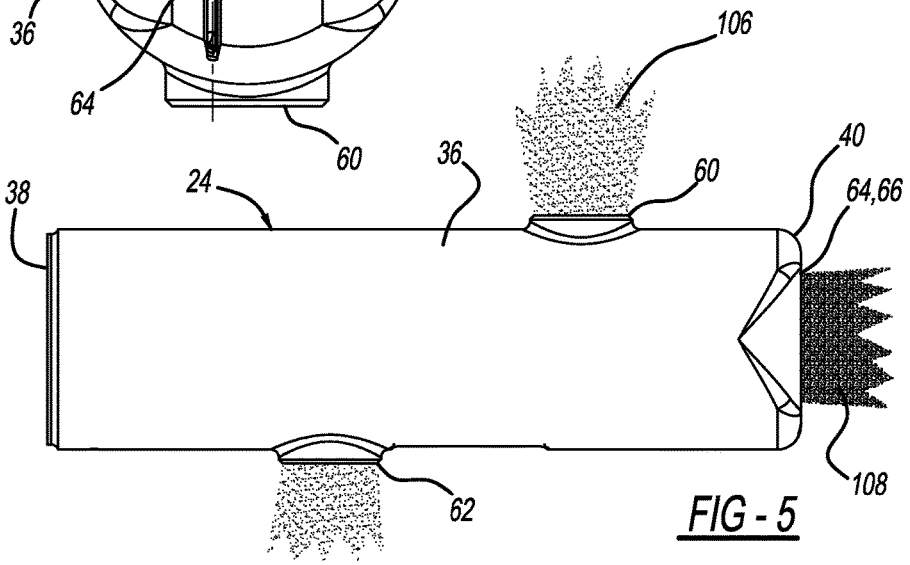
FIG. 5 is a side view of the nozzle block shown in FIG. 3 shown ejecting steam and condensate.

FIG. 5 illustrates operation of nozzle block 24. As illustrated, steam is ejected from nozzle outlets 60 and 62. Higher density condensate is shown being ejected from slots 64 and 66 in this figure (shown overlapping). It should be noted that the nozzle blocks in accordance with this invention may not entirely eliminate condensate ejected from sootblower nozzle block cleaning nozzles. However, the substantial reduction in such undesirable condensate ejection is provided which may have a significant positive effect on boiler operation.

Nozzle block 24 in accordance with this invention has features which provide an additional mechanism for condensate separation and ejection beyond those previously described. In the prior description, the principle of using a centrifugal force effect with higher density condensate is described. This is useful for handling condensate entrained within the cleaning medium flow or adhering to certain surfaces of the flow passageway. It is further the case that condensate tends to collect and flow along the inside wall surfaces of the flow passageways due to the lower fluid velocity encountered at the wall surfaces, a quenching effect provided by cooling of the cleaning medium at the wall surfaces, and a surface tension effect caused by the liquid contacting the wall surfaces. These factors can lead to a layer of condensate flowing along the internal nozzle wall surfaces. Nozzle block 24 incorporates features designed to intercept condensate flowing along the nozzle passageway flow surfaces to direct it toward and out of slots 64 and 66.

Figure 9:
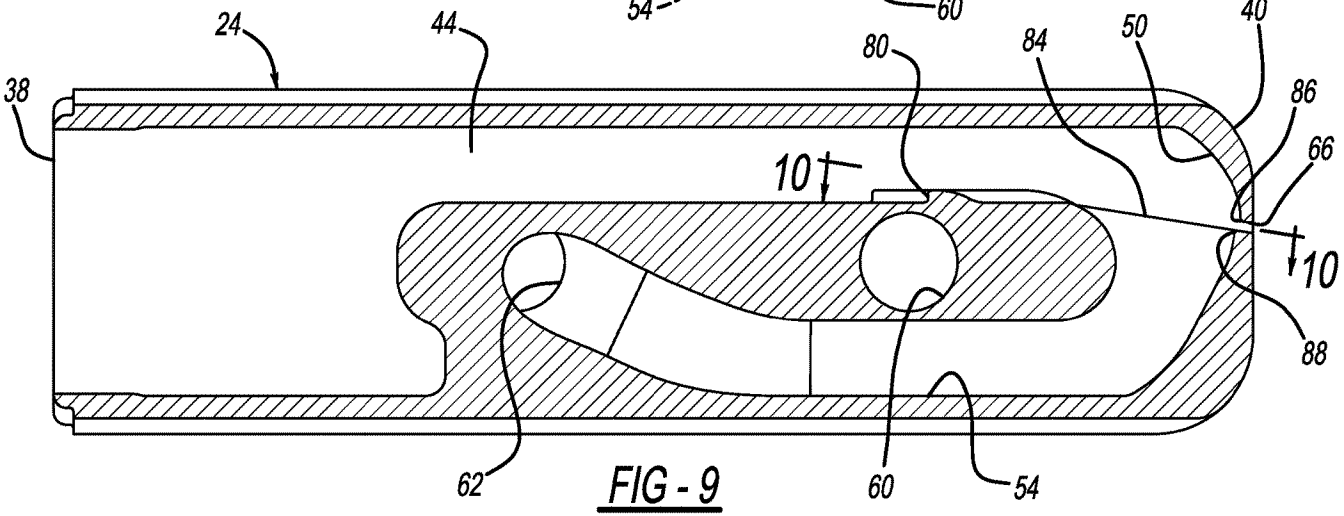
FIG. 9 is a cross-sectional view through the nozzle block.
Figure 10:
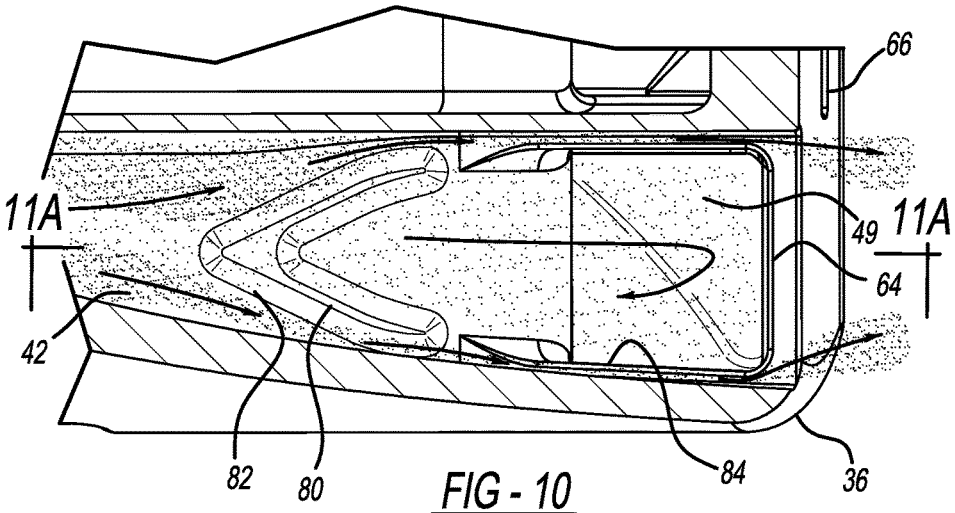
FIG. 10 is a partial cross-sectional view taken along line 10-10 from FIG. 9.
Figure 11A:
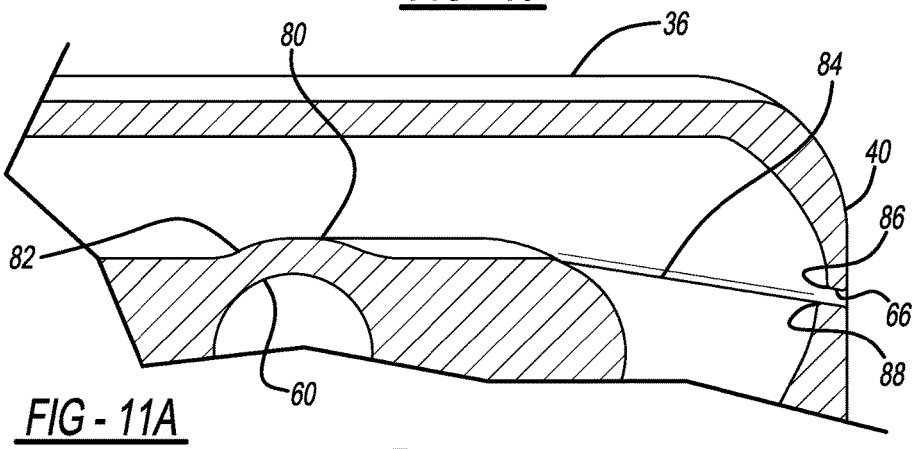
FIG. 11A is a cross-sectional view taken along line 11A-11A from FIG. 10.
Figure 11B:
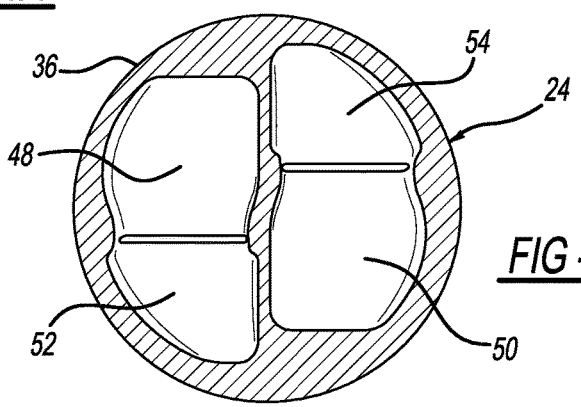
FIG. 11B is a cross-sectional view taken along line 11B-11B from FIG. 13.
Figure 12:
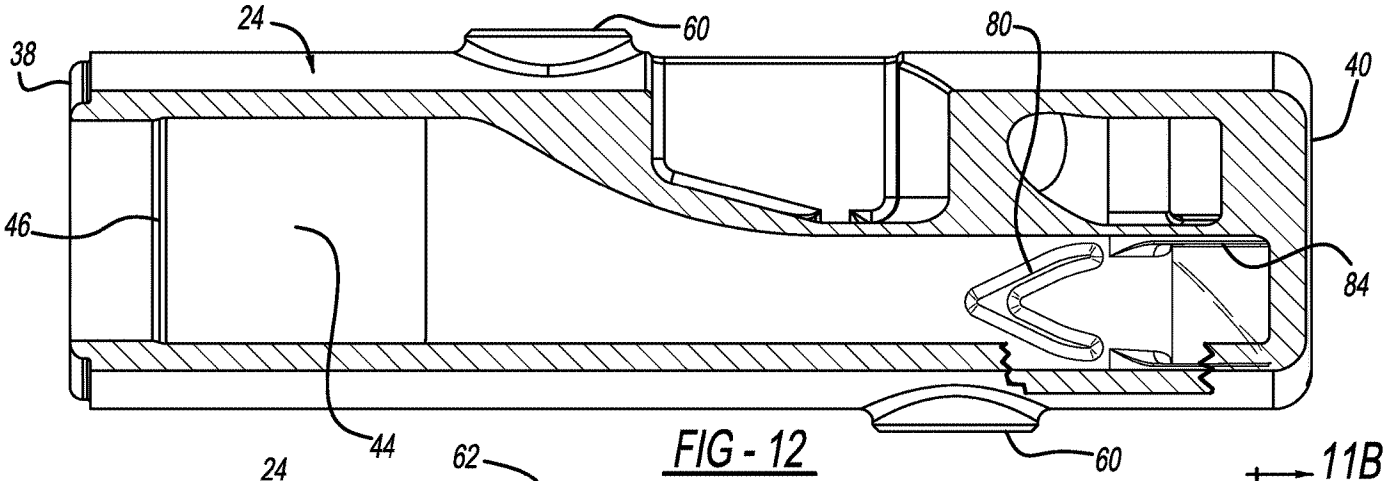
FIG. 12 is a cross-sectional view through a nozzle block in accordance with this invention.
Figure 13:
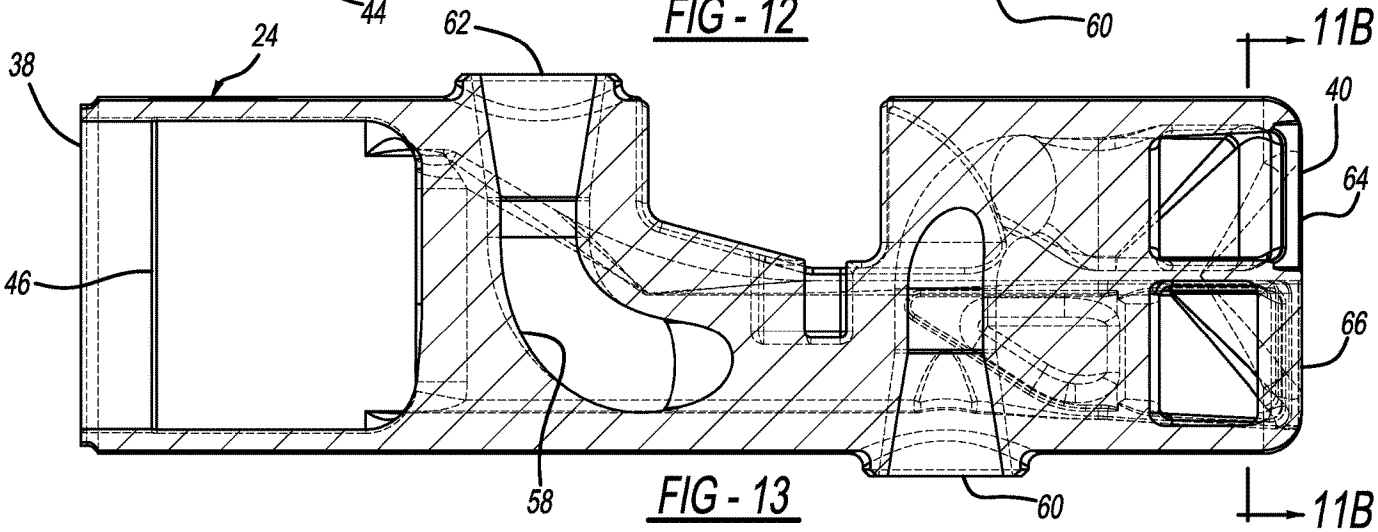
FIG. 13 is another cross-sectional view through a nozzle block in accordance with this invention.

FIGS. 9 and 10 in particular illustrate the provision of water corral 80, which is a raised V-shaped (as seen in FIG. 10) wall 82 formed on the inside wall surface of axial flow passageways 48 and 50 just before U-turns 49 and 51 (inside refers to the surface near the inner radii of the turns). Condensate adhering on the inside wall surface 76 (best shown in FIG. 10) encounters wall 82 and is diverted to flow toward another wall feature termed a wall scraper 84 in the form of a ledge or fin which directs the condensate toward the outside surface of the flow passageway and toward slots 64 and 66. A pair of wall scrapers 84 are provided for each axial flow passageways 48 and 50, and begin at the edges 82 of water corral 80 from the inside surface of the nozzle passageway toward the outer surface at the edges of slots 64 and Condensate collecting on the inside surface of nozzle axial flow passageway 48 and 50 just before U-turns 49 and 51 is intercepted by water corral 80 and is directed to flow toward water corral edges 82 and onto wall scrapers 84, and then toward and out of slots 64 and 66. To promote such flow, wall scrapers 84 are angled such that there is a component of flow velocity of the cleaning medium which tends to move the liquid along the wall scrapers toward slots 64 and 66. In other words, at slots 64 and 66, wall scraper 84 is downstream as the cleaning medium flows as compared to its section at water corral edges 82. Condensate which is on the lateral surfaces of axial flow passageway 40 and 50 will be intercepted by wall scrapers 84. As mentioned previously, condensate which is on the outer surface of the axial flow passageways at U-turns 49 and 51 will be intercepted by slots 64 and 66.

Now with reference to FIG. 9 another optional feature of slots 64 and 66 is illustrated. As shown, slot 64 can be described as having a near edge 86 and a far edge 88. Near edge 86 is the first edge that is encountered by condensate flowing toward slot 66. As shown, far edge 88 extends further toward the midline of the passageway and thus presents an offset upstanding wall section 88 for the enhanced interception of condensate. In one exemplary embodiment of the present invention, the offset of far edge 88 is 0.100 inch. It is expected that the effect distance is greater than 0.050 inch.

Figure 14A:
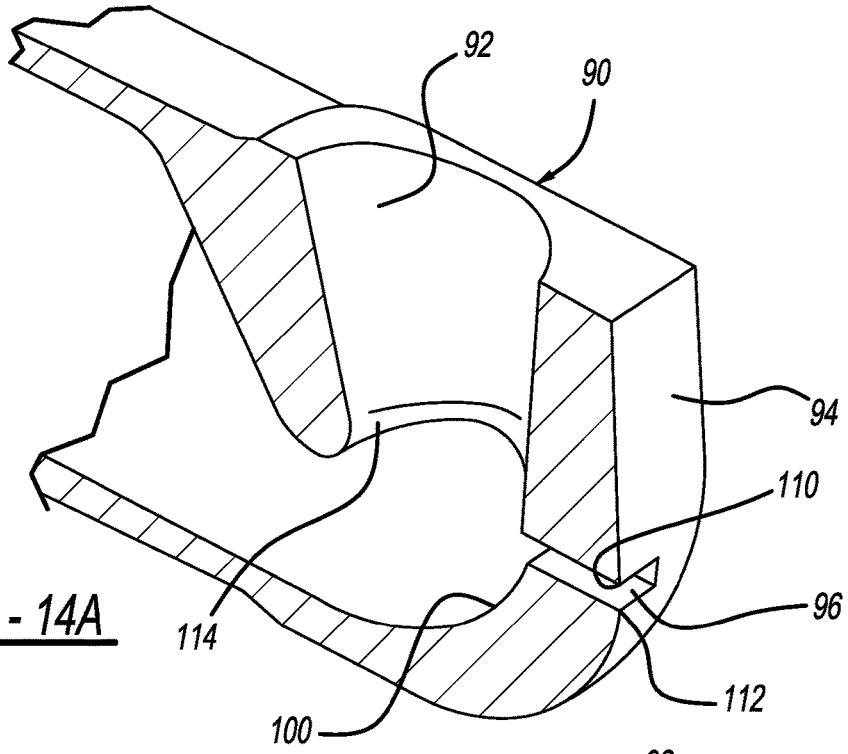
FIG. 14A is a pictorial view showing partially in longitudinal section of the nozzle block in accordance with a second embodiment of this invention having a condensate ejection port.
Figure 14B:
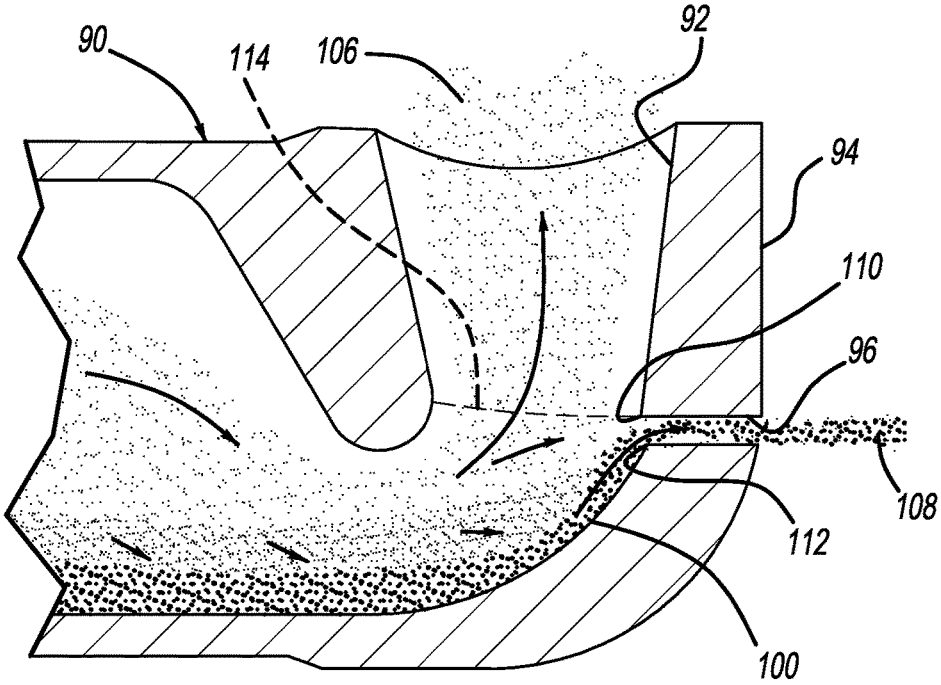
FIG. 14B is a cross-sectional view of the nozzle block shown in FIG. 14A.

A second embodiment of a nozzle in accordance with this invention is shown in FIGS. 14A and 14B and is generally designated by reference number 90. Nozzle block 90 does not feature the reverse direction flow paths of the previously described embodiment and does not provide a separation between two nozzle flow paths. Instead, nozzle block 90 is a cast structure in which the inside cavity of the nozzle block 90 is restricted and causes the flow of cleaning medium to undertake an approximately 90° turn at distal end 94. Nozzle block 90 uses some of the features provided by applicant's previously issued U.S. Pat. No. 6,764,030 (which is hereby incorporated by reference) in that it provides a smooth flow passageway for the cleaning medium to increase nozzle cleaning efficiency.

Nozzle block 90 incorporates one principal feature of the present invention for the ejection of condensate; namely, slot 96. Nozzle block 90 may feature a second nozzle outlet (not shown) positioned upstream of the distal end 94 for discharge of cleaning medium, preferably in a direction diametrically opposite the flow of medium from nozzle outlet 92. Slot 96 is provided at the distal end at a region where the cleaning medium undergoes a high rate of change in direction and is provided at the outer surface 100 of that flow path turn. As shown best in FIG. 14B, the cleaning medium flowing toward the right-hand direction in the figure is caused to move downwardly and undergoes a rapid change in direction in the turn toward nozzle outlet 92. The arrows in the figures show, based on the density of the dots and speckles in the drawing signifying that the higher density fluid condensate 108 collects along the bottom surface of the passageway where is directed toward an out of slot 96.

In a manner as described previously, ejection slot 96 is provided as an ejection port for condensate. As in the case of the prior embodiment, slot 96 has a width (W) significantly less than its length (L) and the slot is cut in a manner such that its width dimension is parallel to the flow path of the cleaning medium. Accordingly, slot 96 operates in a manner of the prior embodiment in that condensate flow is interrupted by the presence of the slot and becomes ejected safely from the nozzle block. Moreover, the cross-sectional flow area of slot 96 is minimized to reduce efficiency loss in the operation of the nozzle block. The length (L) of ejection slot 96 extends to approximately the diameter of the throat 114 (minimum diameter section) of nozzle outlet 92. Slot 96 may have a cross-sectional area about 15% of that defined by throat 114 of nozzle outlets 92. In addition, slot 96 may have the far wall 110 offset from near wall 112, for example by an amount of 0.100 inch. Such an offset is evident in the cross-sectional view FIG. 14B.

While the above description constitutes the preferred embodiment of the present invention, it will be appreciated that the invention is susceptible to modification, variation, and change without departing from the proper scope and fair meaning of the accompanying claims.

What is claimed is:

1. A nozzle block for a sootblower lance tube of a sootblower for cleaning internal surfaces of a combustion device, the sootblower using steam, a mixture of steam and air, or a fluid, or a mixture as a cleaning medium wherein at least a component of the cleaning medium is subject to forming or having a condensate, comprising;

the nozzle block having an internal flow passageway formed by an internal wall surface for the cleaning medium, the internal flow passageway undergoing a turn at near a distal end of the nozzle block and terminating at a cleaning nozzle from which the cleaning medium is ejected toward the internal surfaces, and the nozzle block further forming a condensate ejection slot positioned at the distal end of the nozzle block in communication with the internal flow passageway and along an outside portion of the internal wall surfaces of the turn, the slot extending along a midline parallel to a length of the slot and the slot defining a width, the width of the slot being nearly constant along the slot length, the midline oriented at or near perpendicular to the direction of flow of the cleaning medium and at the outside portion of the internal wall surface of the turn, wherein the condensate present in the cleaning medium may be ejected from the slot before the cleaning medium is emitted from the cleaning nozzle, wherein the slot defines a near edge and a far edge on the outside internal surface of the turn, the near edge positioned upstream of the far edge with respect to the flow of the cleaning fluid and the condensate, and wherein the far edge extends further toward the center of the internal flow passageway thereby forming an offset extending wall.

2. A nozzle block in accordance with claim 1 further comprising the slot having a length at least five times the width dimension.

3. A nozzle block in accordance with claim 1 wherein the slot midline is straight and the slot has a generally rectangular configuration.

4. A nozzle block in accordance with claim 3 further comprising the slot having a cross-sectional area less than approximately 15% of the cross-sectional area of the cleaning medium flow path through the cleaning nozzle.

5. A nozzle block in accordance with claim 1 wherein the far edge defines an offset distance of approximately 0.100 inch.

6. A nozzle block in accordance with claim 1 wherein the nozzle internal flow passageway terminates at the cleaning nozzle positioned adjacent the distal end of the nozzle block.

7. A nozzle block in accordance with claim 6 further comprising the turn undergoing approximately a 90° change in direction.

8. A nozzle block in accordance with claim 1 further comprising a wall scraper in the form of an upstanding wall along the internal wall surface oriented to direct condensate flowing along the internal wall surface of the passageway toward the slot.

9. A nozzle block in accordance with claim 8 further comprising the wall scraper upstanding wall beginning at an inside portion of the internal wall surface of the turn and extending downstream with respect to the fluid flow toward the slot.

10. A nozzle block in accordance with claim 9 further comprising a water corral in the form of an upstanding wall formed on the internal wall surface of the flow passageway at the turn and transitioning to the wall scraper wherein the condensate flowing along the internal wall of the flow passageway at the turn engages the water corral and is guided to flow toward and along the wall scraper.

11. A nozzle block in accordance with claim 1 further comprising the internal flow passageway defining a first internal flow passageway and further comprising a second internal flow passageway, the first and second nozzle passageways terminating at first and second nozzles respectively.

12. A nozzle block in accordance with claim 11 further comprising the turn for each of the first and the second passageways undergoing approximately a 180° change in direction at the turn.

13. A nozzle block in accordance with claim 11 further comprising the first and the second nozzles being oriented to eject the cleaning medium in diametrically opposite directions and the first and the second nozzles being offset along the length of the nozzle block and displaced from the nozzle block distal end.

14. A nozzle block in accordance with claim 11 wherein the first and the second nozzle passageways each extend toward the distal end of the nozzle block and each form respective first and second axial flow sections and the turn in the form of respective first and second U-turns transitioning to respective first and second retrograde sections and thereafter to the respective of the first and the second nozzles.

15. A nozzle block in accordance with claim 14 wherein the first and the second nozzle passageways are intertwined such that the first nozzle is positioned closer to the distal end than is the second nozzle.

16. A nozzle block in accordance with claim 15 further comprising the nozzle block defining a diametric midplane with a divider wall separating the flow of the cleaning medium between the first and the second passageways, the divider wall positioned on the midplane, the midplane defining first and second sides thereof, the first nozzle passageway first axial flow passageway on the first side of the midplane, and having the first U-turn section crossing the midplane, and having the first retrograde portion on the second side of the midplane and having the first nozzle having a center on the midplane.

17. A nozzle block in accordance with claim 16 further comprising the second nozzle passageway second axial flow passageway on the second side of the midplane, and having the second U-turn section crossing the midplane, and having a second retrograde portion on the first side of the midplane and having the second nozzle having a center on the midplane.

18. A nozzle block in accordance with claim 14 further comprising the slot in the form of a first and a second slot respectively communicating with the first and the second nozzle passageways at the first and the second U-turns.

19. A nozzle block for a sootblower lance tube of a sootblower for cleaning internal surfaces of a combustion device, the sootblower using steam, a mixture of steam and air, or a fluid, or a mixture as a cleaning medium wherein a component of the cleaning medium is subject to forming or having a condensate, comprising;

the nozzle block having a first and a second internal flow passageway formed by internal wall surfaces for the cleaning medium, the nozzle block forming a divider wall which separates the cleaning medium flow in the lance tube between the first and the second flow passageways, the first and the second internal flow passageways each having respective first and second turns at near the distal end of the nozzle block and terminating at respective first and second cleaning nozzles from which the cleaning medium is ejected toward the internal surfaces, and the nozzle block further forming a first and a second condensate ejection slot positioned at the terminal end of the nozzle block in communication with the respective first and second internal flow passageways and along an outside portion of the internal wall surfaces of the first and the second turns, the slots each extending along a midline parallel to the length of the slots and the slots defining a width, the width of the slots being nearly constant along the slots length, the midline oriented at or near perpendicular to the direction of flow of the cleaning medium at the first and the second turns, wherein the condensate present in the cleaning medium may be ejected from the first and the second slots before the cleaning medium is emitted from the cleaning nozzles.

20. A nozzle block in accordance with claim 19 further comprising the first and the second slots each having a length at least five times a width dimension.

21. A nozzle block in accordance with claim 20 wherein midlines of the first and the second slots are straight and the first and the second slots each having a generally rectangular configuration.

22. A nozzle block in accordance with claim 19 further comprising the first and the second slots having a cross-sectional area less than approximately 15% of the cross-sectional area of the cleaning medium flow path through the respective first and second cleaning nozzles.

23. A nozzle block in accordance with claim 19 wherein the first and the second slots each defines a near edge and a far edge on an inside portion of the internal wall surfaces of the turns, the near edge positioned upstream of the far edge with respect to the flow of the cleaning fluid and the condensate, and wherein the far edges extends further toward the center of the first and the second flow passageway thereby forming an offset extending wall.

24. A nozzle block in accordance with claim 23 wherein the far edges defining an offset distance of approximately 0.100 inch.

25. A nozzle block in accordance with claim 19 further comprising a wall scraper in the form of an upstanding wall along the first and second nozzle passageways oriented to direct the condensate flowing along the internal wall surfaces of the passageways toward the respective first and the second slots.

26. A nozzle block in accordance with claim 25 further comprising the wall scraper upstanding wall beginning at an inside portion of the internal wall surface of the turns and extending downstream with respect to the fluid flow toward the respective slot.

27. A nozzle block in accordance with claim 26 further comprising a water corral in the form of an upstanding wall formed on the inside surfaces of the flow passageways at the turns and transitioning to the wall scrapers wherein condensate flowing along the inside wall surface of the flow passageways at the turns engage the water corral and is guided to flow toward and along the wall scraper.

28. A nozzle block in accordance with claim 19 further comprising the first and the second nozzles being oriented to eject the cleaning medium in diametrically opposite directions and the first and the second nozzles being offset along the length of the nozzle block and displaced from the nozzle block distal end.

29. A nozzle block in accordance with claim 28 wherein the first and the second nozzle passageways each extend toward the distal end of the nozzle block and each form respective first and second axial flow sections and the turns in the form of respective first and second U-turns transitioning to respective first and second retrograde sections and thereafter to the respective of the first and the second nozzles.

30. A nozzle block in accordance with claim 29 wherein the first and the second nozzle passageways are intertwined such that the first nozzle is positioned closer to the distal end than is the second nozzle.

31. A nozzle block in accordance with claim 30 further comprising the nozzle block defining a diametric midplane with the divider wall positioned on the midplane, the midplane defining first and second sides thereof, the first nozzle passageway first axial flow passageway on the first side of the midplane, and having the first U-turn section crossing the midplane, and having the first retrograde portion on the second side of the midplane and having the first nozzle having a center on the midplane.

32. A nozzle block in accordance with claim 31 further comprising the second nozzle passageway second axial flow passageway on the second side of the midplane, and having the second U-turn section crossing the midplane, and having a second retrograde portion on the first side of the midplane and having the second nozzle having a center on the midplane.

33. A nozzle block in accordance with claim 19 further comprising the slot in the form of a first and a second slot respectively communicating with the first and the second nozzle passageways at the first and the second U-turns.

34. A nozzle block for a sootblower lance tube of a sootblower for cleaning internal surfaces of a combustion device, the sootblower using steam, a mixture of steam and air, or a fluid, or a mixture as a cleaning medium wherein at least a component of the cleaning medium is subject to forming or having a condensate, comprising;

the nozzle block having an internal flow passageway formed by an internal wall surface for the cleaning medium, the internal flow passageway undergoing a turn at near a distal end of the nozzle block and terminating at a cleaning nozzle from which the cleaning medium is ejected toward the internal surfaces, and the nozzle block further forming a condensate ejection slot positioned at the distal end of the nozzle block in communication with the internal flow passageway and along an outside portion of the internal wall surfaces of the turn, the slot extending along a midline parallel to a length of the slot and the slot defining a width, the width of the slot being nearly constant along the slot length, the midline oriented at or near perpendicular to the direction of flow of the cleaning medium and at the outside portion of the internal wall surface of the turn, wherein the condensate present in the cleaning medium may be ejected from the slot before the cleaning medium is emitted from the cleaning nozzle, wherein the slot midline is straight and the slot has a generally rectangular configuration, and wherein the slot has a cross-sectional area less than approximately 15% of the cross-sectional area of the cleaning medium flow path through the cleaning nozzle.

* * * * *